United States Patent [19]

Alexander

[11] Patent Number: 4,648,806

[45] Date of Patent: Mar. 10, 1987

[54] GAS COMPRESSOR

[75] Inventor: Jack L. Alexander, Tulsa, Okla.

[73] Assignee: Combustion Engineering, Inc., Windsor, Conn.

[21] Appl. No.: 743,850

[22] Filed: Jun. 12, 1985

[51] Int. Cl.[4] ..... F04B 9/04; F16C 3/06

[52] U.S. Cl. ..... 417/238; 417/364; 74/595; 74/599; 92/13

[58] Field of Search ..... 92/13; 417/364, 238, 417/254, 244; 74/595, 599

[56] References Cited

U.S. PATENT DOCUMENTS

| | | | |
|---|---|---|---|
| 764,573 | 7/1904 | Furru | 417/238 X |
| 1,169,076 | 1/1916 | Greve | 74/595 X |
| 1,349,094 | 8/1920 | Owen | 74/595 X |
| 1,783,825 | 12/1930 | Brown et al. | 74/595 |
| 1,998,772 | 4/1935 | Swartz et al. | 92/13 X |
| 2,206,613 | 7/1940 | Londuis | 417/238 |
| 2,975,599 | 3/1961 | Bennett | 92/13 X |
| 3,204,859 | 9/1965 | Crooks | 417/364 X |
| 3,929,058 | 12/1975 | Smith | 92/13 |
| 4,173,951 | 11/1979 | Ishihara | 417/364 X |
| 4,233,850 | 11/1980 | Edwardson | 74/600 X |
| 4,509,474 | 4/1985 | Schmuck | 417/364 X |

FOREIGN PATENT DOCUMENTS

| | | | |
|---|---|---|---|
| 482596 | 7/1953 | Italy | 92/13 |
| 512307 | 7/1976 | U.S.S.R. | 92/13 |

*Primary Examiner*—Carlton R. Croyle
*Assistant Examiner*—Theodore W. Olds
*Attorney, Agent, or Firm*—Arthur E. Fournier, Jr.

[57] ABSTRACT

An integral gas compressor-prime mover utilizes the prime mover power shaft (18) to drive a crank plate (20). The plate (20) includes a plurality of securing sites (40) among which a crank pin (24) is selectably securable for changing the stroke length of the reciprocating compressor piston (56). A crosshead connector asembly (32) is provided to linearize the motion of the crank pin (24).

4 Claims, 8 Drawing Figures

GAS COMPRESSOR

FIELD OF THE INVENTION

The present invention relates to a gas compressor, and more particularly, to a reciprocating compressor driven directly by a prime mover or the like.

BACKGROUND OF THE INVENTION

The use of motor driven compressor units for elevating the pressure of a flow of gas is well distributed throughout the industrial community. Such compressors are available from a number of equipment manufacturers, and use a wide variety of mechanical principles for accomplishing the desired pressurization.

A significant fraction of these units are of the reciprocating piston type, wherein a compressor piston is reciprocated within a close fitting cylinder which is enclosed about at least one end. Such units accept low pressure gas into the cylinder as the piston is withdrawn, and push the gas out of the cylinder at a higher pressure as the piston is driven inward toward the closed end. The flow of gas into and out of the closed portion of the cylinder-piston combination is directed by a plurality of gas valves which may be manipulated mechanically by linkages or the like. As is well known to those skilled in the art of gas compression, such reciprocating compressors may utilize a plurality of cylinder-piston combinations in a single compressor unit, may be either single-or double-acting (wherein the piston-cylinder combination discharges higher pressure gas as the piston is stroked in each direction), and may include a two or more stage flow arrangement, wherein the gas is partially compressed in a first stage collection of cylinder-piston combinations and then is elevated to a higher pressure in a second set.

A continuing problem for process designers has been the matching of the particular needs of a process or application with the various models of gas compressors and prime movers available in the marketplace. As will be appreciated by those skilled in the art, such selection must be made as accurately as possible in order to avoid paying for additional, unwanted compressor capacity, or even worse, specifying a compressor-prime mover combination of insufficient capacity for the particular application.

In making such a selection, the designer will typically know the flow rate and pressure of the incoming gas, as well as the desired output pressure. With such information, the required power of the prime mover may be estimated with a fair degree of accuracy, taking into account the mechanical efficiency of the drive coupling, auxiliaries such as cooling, etc. It is typical for most compressor manufacturers to standardize their equipment among a limited number of frames, each frame being suitable for a range of input power. As will again be appreciated by those skilled in the art, purchase of an oversized, heavy compressor frame results in an unnecessarily high capital cost, while use of a compressor frame undersized for the given compressor output will result in an increased number of equipment failures and increased maintenance time and costs.

For typical reciprocating compressors, the choice of a particular compressor frame means that the stroke of the individual pistons is also determined. Thus, in a typical reciprocating compressor application the pressure differential and mass flow of the flowing gas determines the size of the prime mover, the size of the prime mover determines the particular compressor frame, and the choice of compressor frame determines the stroke length of the compressor piston. As most prime movers operate most efficiently at a particular speed, the only remaining variable to the equipment designer is the compressor piston diameter. Compressor manufacturers thus offer a number of different diameter cylinder-piston combinations for use on a particular frame, but the number of such options is finite and often results in a compromise match for a particular desired volumetric gas flow rate.

As will be appreciated by those skilled in the art, a later change in the gas flow rate, pressure differential, or other gas properties may result in a significant mismatch between the application and the existing compressor-prime mover. As discussed hereinabove, it may be possible to adapt the existing unit by swapping cylinders and pistons onto the existing compressor frame, but such changes require new components and such decisions are typically made against the background choices of either purchasing an entirely new compressor-motor unit or providing a new cylinder-piston combination to the existing unit which will still be mismatched to the new application. In such situations a very large mismatch will typically be tolerated before the decision is made to purchase an entirely new unit.

One particular application in which these problems are common is the use of gas compressors in the production of natural gas. Natural gas is typically produced from a number of widespread, remote fields, each field being able to produce only a relatively small amount of gas. Such situations require a number of small compressors, sized to the particular application, and distributed among the individual fields. Not only must each of these compressor-prime mover units operate dependably and cheaply over a long period of time, but it is frequently necessary to alter the flow rate or pressure output of these units as the individual gas fields age or as changing economic conditions result in a different optimum production rate.

What is required is a compressor-prime mover unit which is rugged, dependable, and easily adaptable to changed operating conditions.

SUMMARY OF THE INVENTION

The present invention provides a reciprocating gas compressor-prime mover unit that may be easily reconfigured for changing gas flow rate and differential pressure. The unit is also rugged and mechanically reliable, utilizing a minimum of moving parts in the drive train to transfer power directly from the prime mover to the compressor.

Compressor flow volume is altered by repositioning the compressor crank pin among a plurality of threaded securing holes in a rotating crank plate. Each hole is spaced differently from the crank plate's axis of rotation, resulting in a different length stroke of the reciprocating compressor piston. This stroke length variation, in addition to the use of a prime mover having a variable speed ratio, allows the volume rate of flow of a compressor-prime mover unit according to the present invention to be turned down approximately 4 to 1 from the design capacity.

The present invention enhances the durability of the unit by providing an integral frame and crank case wherein the prime mover crank case and the compressor crank case are secured together as a unit, and wherein the power shaft of the prime mover drives the compressor crank plate directly without intervening gears or belts. The use of a slow speed internal combustion engine further enhances the long term reliability of the unit by reducing the number of stress cycles experienced by the reciprocating parts.

An additional feature of the compressor-prime mover unit according to the present invention is the reduced vibration resulting from the use of a single piston internal combustion engine and the arrangement of the compressor piston and the engine piston in an opposing-motion relationship. By requiring the pistons to reciprocate in opposite directions, the momentum of each is canceled by the other and greatly reduces equipment vibration.

BRIEF DESCRIPTION OF THE DRAWING FIGURES

FIG. 1 shows a side elevation of an integral compressor-prime mover according to the present invention.

FIG. 2*a* shows a horizontal cross section of the compressor crank case as indicated in FIG. 1.

FIG. 2*b* shows a horizontal cross section of the compressor cylinder as shown in FIG. 1.

FIG. 3 shows a vertical cross section of the compressor crank case as indicated in FIG. 2.

FIGS. 4*a* and 4*b* show detailed views of the crank plate according to the present invention.

FIGS. 5*a* and 5*b* show detailed views of the crank pin according to the present invention.

DESCRIPTION OF THE PREFERRED EMBODIMENT

Figure 1:
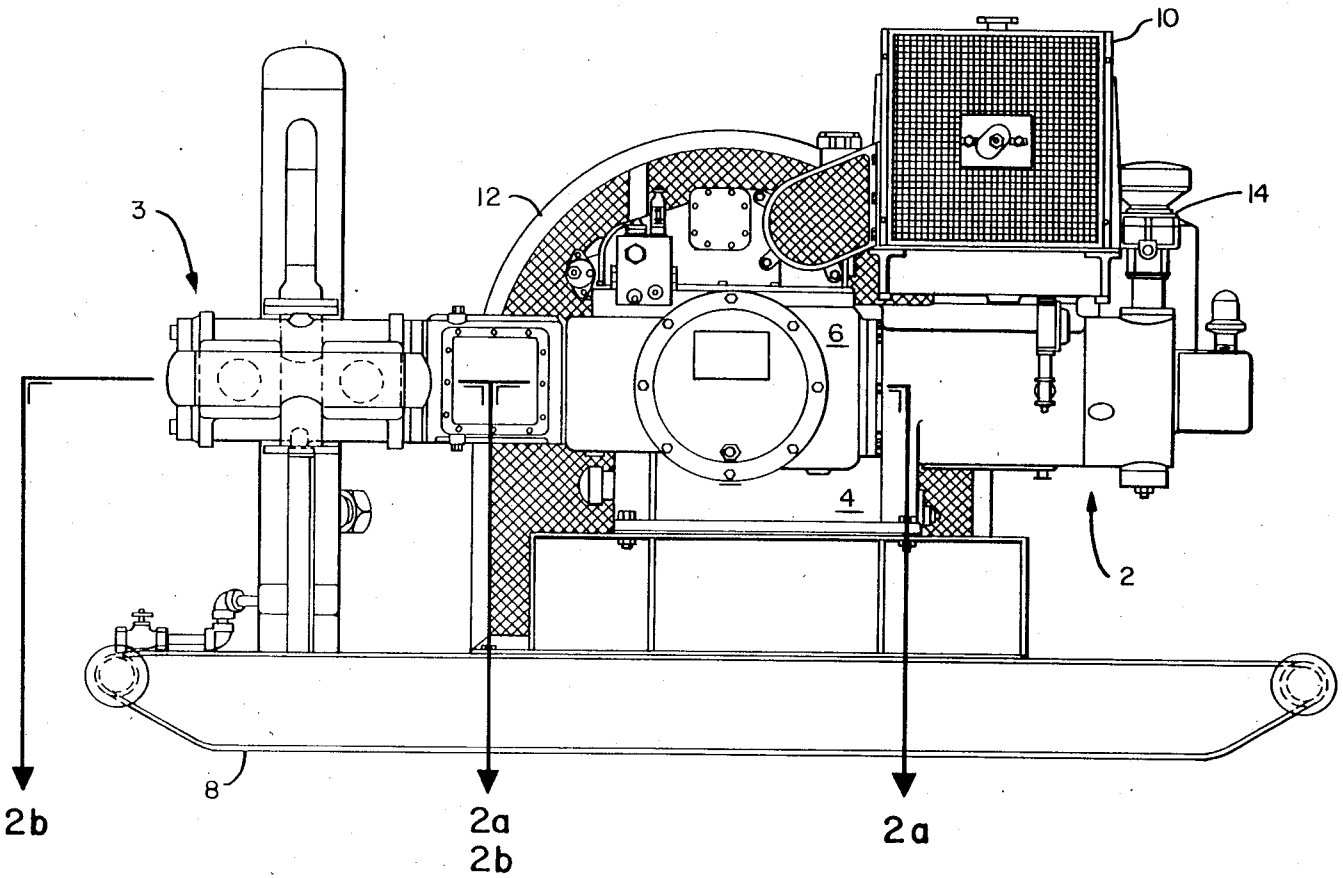

FIG. 1 shows an integrated compressor-prime mover according to the present invention. The unit includes a single cylinder, slow speed internal combustion engine 2 as the prime mover, and a single cylinder compressor 3 coupled thereto. The prime mover crank case 4 and the compressor crank case 6 are shown as being integrally connected, and enclosing the drive train (not shown). The integral unit is mounted on a skid 8 to provide for ease of transfer and placement in a field location. Various features of the internal combustion engine 2 should be apparent to those skilled in the art such as a convective water cooler 10, a flywheel protective housing 12, carburation means 14, etc.

As should also be apparent to those skilled in the art, FIG. 1 shows the internal combustion engine cylinder and the compressor cylinder as being arranged in a horizontally opposing fashion. Such an arrangement reduces the vertical headroom necessary for the unit, as well as reducing the vibration of the equipment as discussed hereinbelow.

Figure 2A:
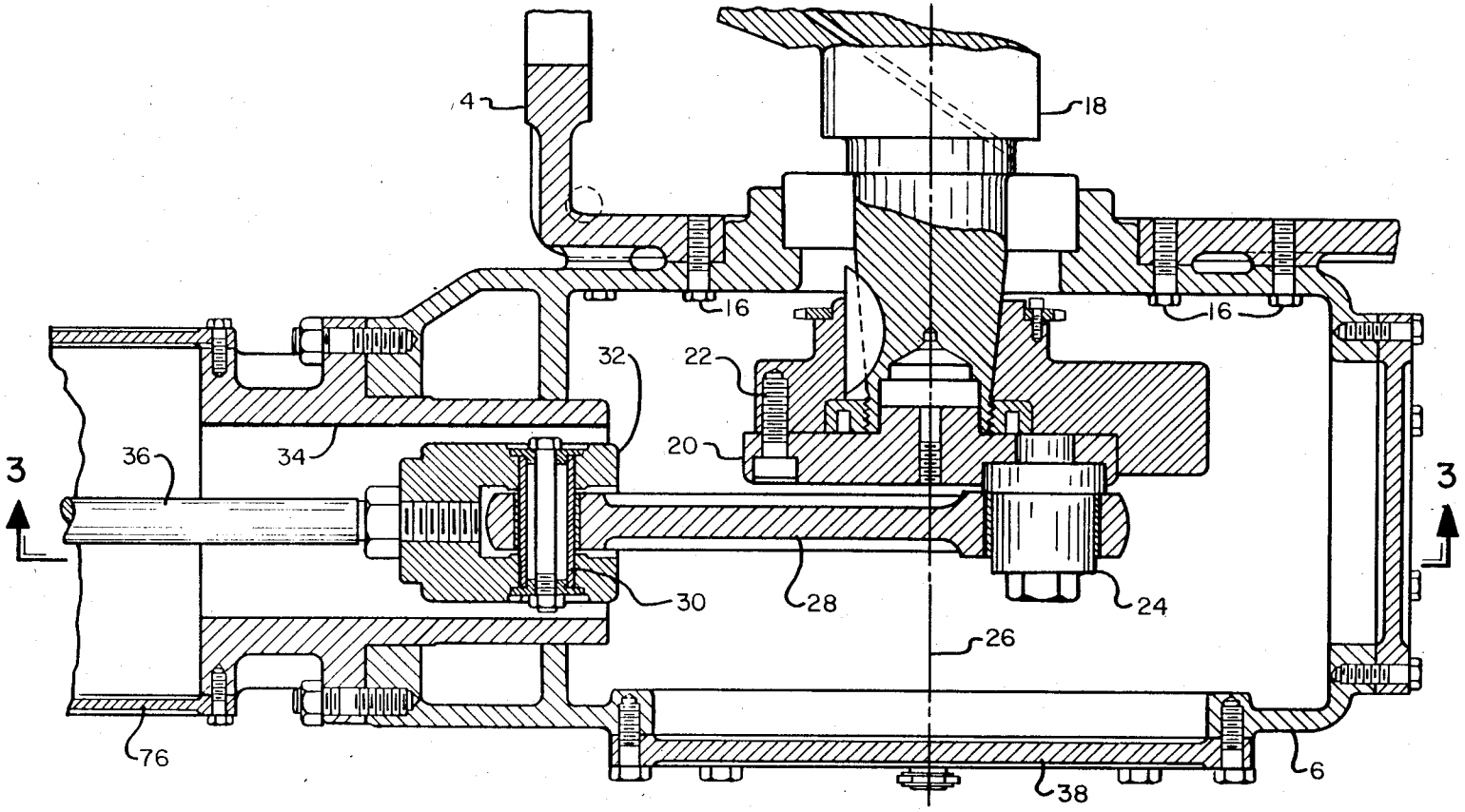

FIG. 2*a* shows a partial horizontal cross section of the compressor crank case 6 as indicated in FIG. 1. The compressor crank case 6 is shown secured to the prime mover crank case 4 by securing means such as the threaded bolts 16. FIG. 2 also shows the power shaft 18 protruding from the prime mover crank case 4 into the interior of the compressor crank case 6.

During operation of the compressor-prime mover unit, power shaft 18 rotates under the influence of the prime mover 2. Crank plate 20 is secured by machine bolts 22 or other securing means to the protruding end of the prime mover shaft 18 and rotates therewith.

A crank pin 24 secured to the crank plate 20 at a position radially spaced apart from the axis of rotation 26 of the prime mover shaft 18 produces the eccentric motion necessary to eventually cause the linear reciprocation of the compressor piston.

As is typical with reciprocating piston devices, a crank rod 28 is engaged at one end with the crank pin 24, and at the other end with a wrist pin 30 disposed in a sliding crosshead assembly 32.

Figure 2B:
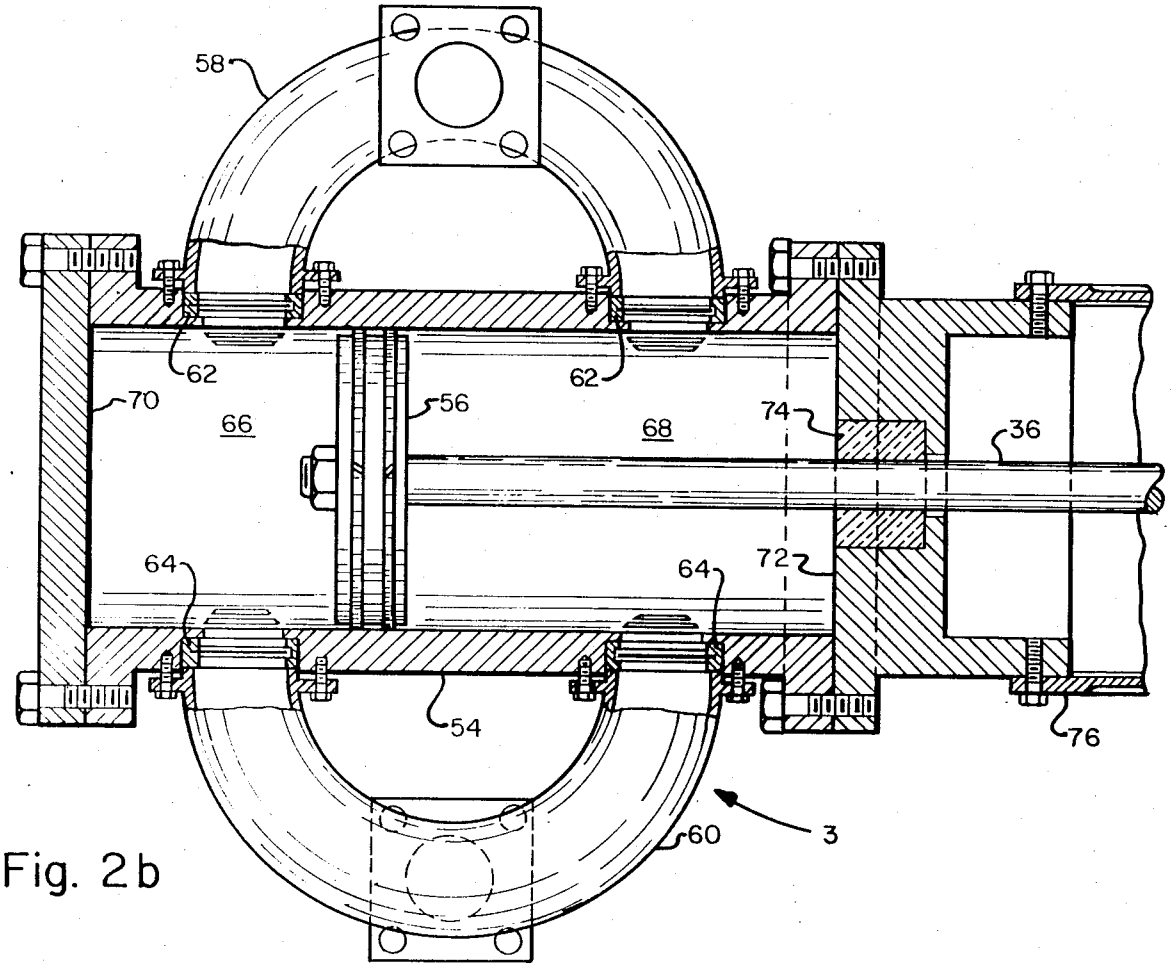

FIG. 2*b* shows a typical compressor cylinder assembly 3 including a cylinder 54, compressor piston 56, suction manifold 58, and exhaust manifold 60. Compressor piston 56 is secured to the connecting rod 36 and reciprocated thereby. Suction check valves 62 and exhaust check valves 64 regulate the flow of gas into and out of the cylinder 54. Compression chambers 66, 68 are sealed by the cylinder head 70 and the spacer assembly 72 which includes a connecting rod packing 74 disposed about the reciprocating connecting rod 36. A removable plate 76 allows access to the connecting rod 35 and crosshead assembly 30 (See FIG. 2*a*).

FIGS. 2*a* and 2*b* thus show a simple, single-stage, double acting, single cylinder compressor. It should be apparent to those skilled in the compressor art that this assembly 3 could equivalently be replaced by a single acting, single cylinder compressor, a dual piston, single acting steeple compressor assembly, or any other reciprocating compressor design drivable by the single reciprocating connecting rod 36 emerging from the compressor crankcase 6 as disclosed herein.

The function of the crank plate-crank pin-crank rod-crosshead combination 20, 24, 28, 30 is to transform the circular motion of the power shaft 18 into a linear reciprocal motion which may then be transferred to the compressor piston 56. The final step of this process is accomplished by the interaction of the crosshead assembly 32 and the guide tube 34 which constrains the motion thereof into a straight line. As will be appreciated by those knowledgeable of mechanisms and the like, the length of the reciprocating stroke will be equal to the diameter of the locus of points described by the rotation of the crank pin 24 about the power shaft axis 26. This linear reciprocating motion is transferred from the crosshead assembly 32 to the compressor piston 56 by means of a connecting rod 36 or the like.

Access to the interior of the compressor crank case 6 is provided by means of the removable access cover 38. It is thus possible, without extensive disassembly of the compressor and prime mover unit, to access the crank pin 24, crank plate securing means 22, and crank plate 20.

Figure 3:
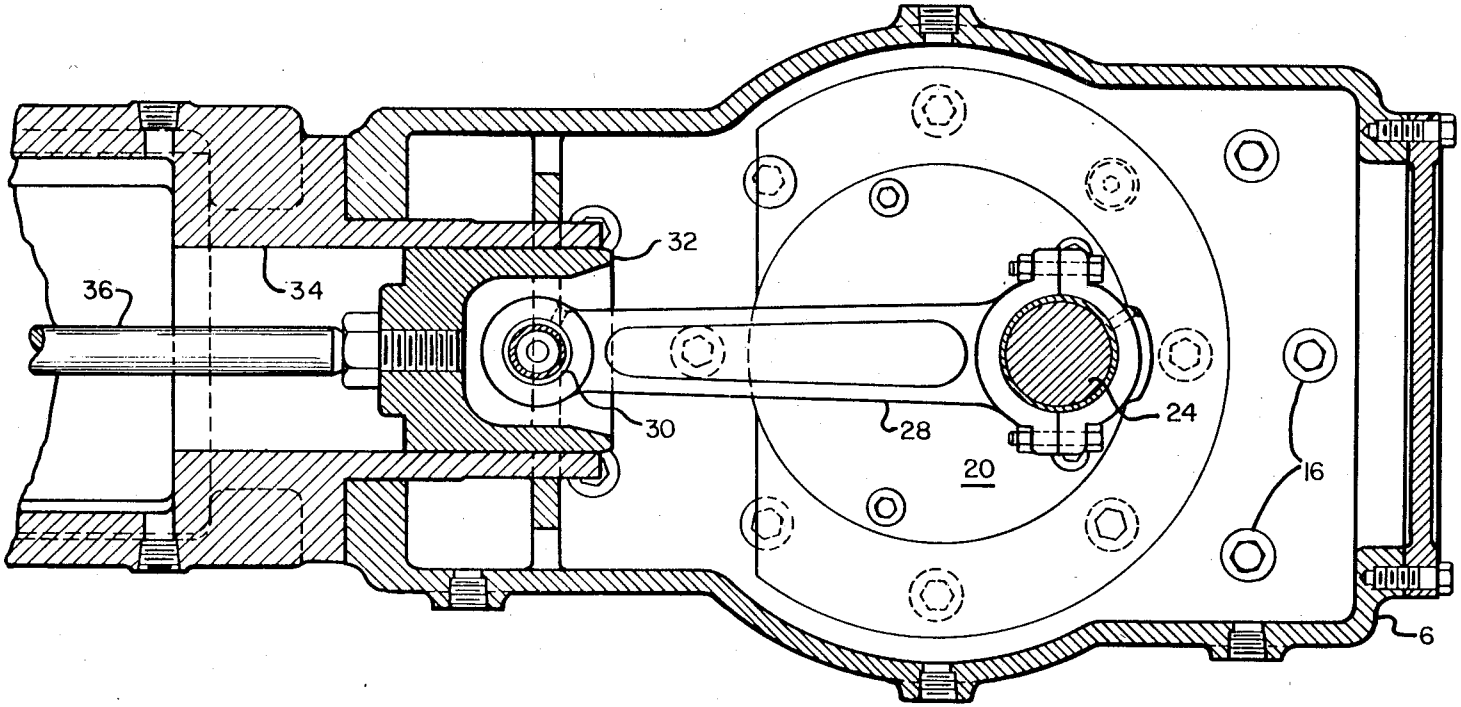

FIG. 3 shows the indicated partial cross section of the compressor crank case 6 and more clearly describes the interrelationship of the crank plate 20, crank pin 24, crank rod 28, and crosshead connector 32. It should be clear to those skilled in the art that the rotation of the crank plate 20 under the influence of the prime mover shaft 18 (not shown in FIG. 3) will produce linear reciprocating motion in the crosshead assembly 32 and hence the compressor piston 56 by means of the connecting rod 36.

Figure 4B:
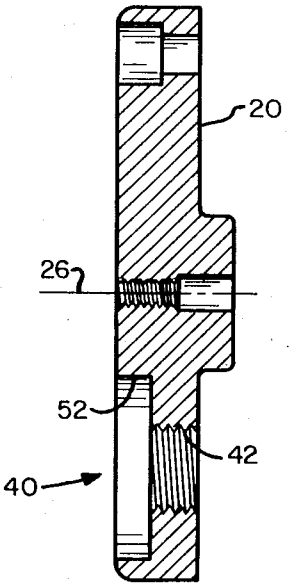
Figure 4A:
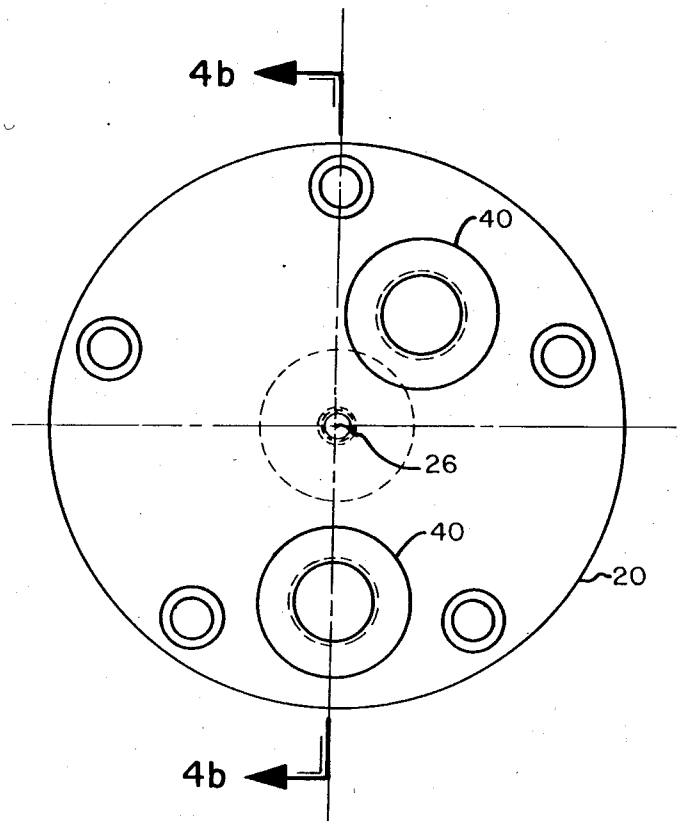

FIGS. 4*a* and 4*b* show a crank plate 20 in both front and sectional side views. Crank plate 20 includes a plurality of securing sites 40 disposed therein at various radial spacings with respect to the center axis 26. The securing sites 40 are adapted to receive the crank pin 24 which is engaged with a threaded portion 42 shown in FIG. 4*b*. Although shown in FIG. 4*a* as only being two in number for the sake of clarity, a typical crank plate 20 could have as many as five or more securing sites disposed therein at differing radial displacements.

In operation the plurality of securing sites provides the unit operator with the opportunity to relocate the crank pin 24 thus changing the length of stroke of the compressor piston. Such a change, easily and quickly accomplished in the field by removing the access plate 38, gives a measure of volume flow flexibility heretofore unknown in compression equipment. Moreover, it is possible and beneficial to relocate the crank plate 20 with respect to the power shaft 18 during such a change by releasing the securing bolts 22 and repositioning the crank plate 20. Such repositioning in concert with a relocation of the crank pin 24 allows the engine-compressor combination to continue to operate in a fully balanced fashion. Volume flow is thus altered without significant expense or time, without extensive equipment disassembly, and without otherwise affecting performance.

Figure 5B:
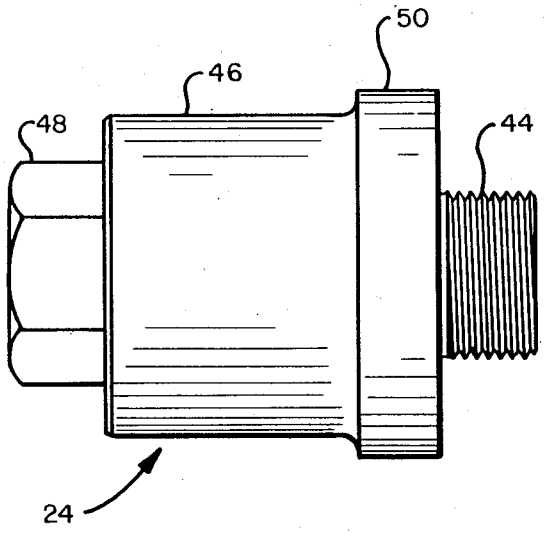
Figure 5A:
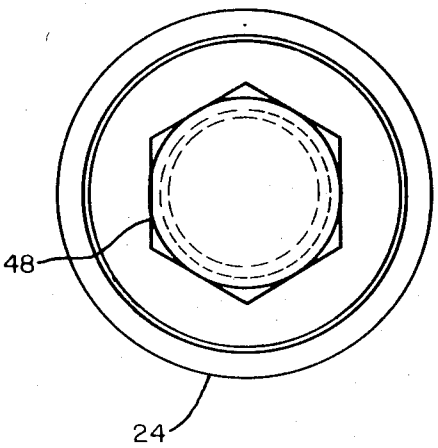

Crank pin 24 is shown in more detail in FIGS. 5*a* and 5*b*. As can be seen in FIG. 5*b*, the crank pin 24 includes a threaded portion 44 engageable with the threaded portion 42 of an individual securing site 40. The crank pin 24 also includes a central portion 46 engageable with the crank rod 28 and a shaped end portion 48 which may be engaged by a wrench or other torque inducing device for securing the crank pin 24 threadedly into an individual securing site 40. Also shown adjacent the threaded portion 44 is a shoulder portion 50, the function of which will be described hereinbelow. As will be appreciated by those skilled in the art of machine design, the crank plate, crank pin, crank rod combination shown in FIGS. 2*a* and 3 will result in a very large transverse force being imparted to the body portion 46 of the crank pin 24 during compressor operation. These forces, caused by the relationship of the crank rod 28 and the crank pin 24, are passed on to the crank plate 20.

For a simple threaded connector engaged with the crank plate 20 it will be apparent that the majority of these transverse forces will be imparted through the threaded portion 44 of the crank pin 24. Such an arrangement creates a very high transverse bending stress at the point of engagement of the threaded connector, frequently leading to cracking and eventual failure. The crank pin 24 and crank plate 20 according to the present invention avoid this undesirable concentration of bending stresses adjacent the threaded portion 44 by providing a counter bore 52 as shown in FIG. 4*b* and a corresponding, closely fitting shoulder portion 50 as shown in FIG. 5*b*. Upon engagement of the threaded portions 42, 44 of the crank plate and crank pin 20, 24, it will be appreciated that a majority if not all of the transverse force applied to the body portion 46 of the crank pin 24 will be transferred directly to the crank plate 20 by means of the interaction of the shoulder 50 and counter bore 52. Threaded portions 42 and 44 thus are stressed only in tension and do not experience the cyclical transverse bending stresses which would lead to early failure of these elements.

With regard to the prime mover 2, the preferred embodiment of the present invention utilizes a slow speed, low compression, internal combustion engine for providing the dependable power generation necessary for the compressor-prime mover unit. By utilizing a low compression engine, the compressor-prime mover according to the present invention is able to run on a wide variety of various grade fuel sources, including, in the case of natural gas production, the very gas that is being compressed. Although the magnitude of the stress on an individual component may not be any greater for engines of differing speeds, the use of a slow speed engine operating at relatively low speeds (300–500 rpm) reduces the number of stress cycles experienced by the reciprocating components of the compressor-prime mover unit thus reducing the chance of premature stress cracking and failure.

The compressor-prime mover combination according to the present invention thus provides an integral unit having the capability of being changed in the field to provide differing flow volume and pressure. The integral unit moreover utilizes a prime mover power shaft 18 as an effective crank shaft for the compressor, eliminating the need for a separate compressor crank shaft and providing a reduction in the number of moving parts. Other design features reduce the possibility of failure of the individual elements, increasing equipment reliability and reducing maintenance costs and downtime.

It is to be understood that the present invention is merely exemplified by the foregoing discussion and the accompanying drawing figures and that the full scope of the invention, including those alternate embodiments which will become apparent to those skilled in the art, is limited only by the appended claims.

I claim:

1. A compressor-prime mover unit for compressing a stream of gas comprising:

a. a prime move including a crank case and a rotatable power shaft protruding in a first direction from said crank case;

b. a compressor crank case secured to said crank case of said prime mover so as to enclose said protruding power shaft;

c. a substantially planar crank plate secured to said power shaft of said prime mover for rotation therewith, said crank plate including a plurality of securing sites formed therein in spaced relation one to another, each of said plurality of securing sites including a threaded hole formed in said crank plate and a counter bore formed in said crank plate in surrounding relation to said threaded hole, each of said plurality of securing sites being located at a different displacement with respect to the axis of rotation of said power shaft of said prime mover;

d. a crank pin selectively positioned in one of said plurality of securing sites so as to extend axially of said crank plate and in parallel relation to the axis of rotation of said power shaft of said prime mover, said crank pin including a threaded portion capable of being threadedly engaged in said threaded hole of any of said plurality of securing sites for purposes of selectively positioning said crank pin in one of said plurality of securing sites and a shoulder formed in juxtaposed relation to said threaded portion of said crank pin so as to be operative when said threaded portion of said crank pin is threadedly engaged in said threaded hole of one of said plurality of securing sites to transfer to said crank plate any lateral thrust imparted to said crank pin;

e. an elongated crank rod having one end thereof operatively connected to said crank pin so that said crank rod is made to move linearly in a second direction when rotation is imparted to said power shaft of said prime mover;

f. a guide tube secured to said compressor crank case so as to lie in a plane extending substantially perpendicular to the axis of rotation of said power shaft of said prime mover;

g. a crosshead connector mounted within said guide tube so as to be slidable longitudinally therewithin, said crosshead connector being operatively connected to the other end of said elongated crank rod so as to be caused to slide longitudinally within said guide tube when said elongated crank rod moves linearly in said second direction;

h. a compression cylinder secured to said guide tube so as to be coaxially aligned therewith;

i. a compressor piston mounted within said compression cylinder so as to be slidable longitudinally therewithin; and j. means operatively connecting said compressor piston to said crosshead connector so as to cause said compressor piston to slide longitudinally within said compression cylinder when said crosshead connector is made to slide longitudinally within said compression cylinder when said crosshead connector is made to slide longitudinally within said guide tube while at the same time maintaining a fixed linear displacement between said compressor piston and said crosshead connector.

2. The compressor-prime mover unit as set forth in claim 1 wherein said prime mover comprises a single piston, slow speed internal combustion engine.

3. The compressor-prime mover unit as set forth in claim 2 wherein said internal combustion engine has a relatively low compression ratio thereby enabling a portion of the gas being compressed in the compressor-prime mover to be utilized as a fuel in said internal combustion engine.

4. The compressor-prime mover unit as set forth in claim 3 wherein said compressor crank case has an access opening formed therein in proximate relation to said crank plate so as to provide free access therethrough to said crank pin and said power shaft of said prime mover, said compressor crank case further including a removable cover operative to cover said access opening in said compressor crank case.

* * * * *